US007631376B2

(12) United States Patent
Peterson et al.

(10) Patent No.: US 7,631,376 B2
(45) Date of Patent: Dec. 15, 2009

(54) EXPANDABLE SLEEPING BAG STORAGE SACK

(75) Inventors: Michael W. Peterson, Park City, KS (US); Susan L. Michaelis, Wichita, KS (US); Timothy M. Holub, Cheney, KS (US)

(73) Assignee: The Coleman Company, Inc., Wichita, KS (US)

( * ) Notice: Subject to any disclaimer, the term of this patent is extended or adjusted under 35 U.S.C. 154(b) by 102 days.

(21) Appl. No.: 11/460,921

(22) Filed: Jul. 28, 2006

(65) Prior Publication Data

US 2006/0260047 A1 Nov. 23, 2006

Related U.S. Application Data

(63) Continuation-in-part of application No. 10/864,971, filed on Jun. 10, 2004, now Pat. No. 7,243,875.

(51) Int. Cl.
*B65D 30/00* (2006.01)
*A47G 9/08* (2006.01)

(52) U.S. Cl. ..... 5/413 R; 383/2

(58) Field of Classification Search ..... 5/413 R, 5/413 AM; 383/2; 53/434
See application file for complete search history.

(56) References Cited

U.S. PATENT DOCUMENTS

| | | | |
|---|---|---|---|
| 606,221 | A | 6/1898 | Kruppa et al. |
| 642,108 | A | 1/1900 | Gilbert |
| 872,404 | A | 12/1907 | Burch |
| 917,403 | A | 4/1909 | Benger |
| 1,341,099 | A | 5/1920 | Abramson |
| 1,636,838 | A | 7/1927 | Roser |
| 1,653,815 | A | 12/1927 | Millar |
| 1,712,448 | A | 5/1929 | Eckhardt |
| 1,934,360 | A | 11/1933 | Laufman |

(Continued)

FOREIGN PATENT DOCUMENTS

| | | | |
|---|---|---|---|
| CA | 2265337 | A1 | 9/1999 |

(Continued)

OTHER PUBLICATIONS

International Search Report from corresponding PCT/US2007/074240; international filing date Dec. 4, 2005.

(Continued)

*Primary Examiner*—Michael Trettel
(74) *Attorney, Agent, or Firm*—Kelly S. Elsea

(57) ABSTRACT

A tightly rolled sleeping bag. The tightly rolled sleeping bag is rolled using conventional equipment, but pressure is applied to an end of the sleeping bag so as to cause the sleeping bag to be more tightly rolled than previous sleeping bags. Rolling tines for a rolling machine for rolling the sleeping bag are tapered so as to aid in removal of the tightly rolled sleeping bag. A storage sack is provided for holding the sleeping bag. The storage sack is configurable between a first arrangement where the storage sack holds the sleeping bag in the tight configuration, and a second arrangement where the storage sack may be released and expands to hold the sleeping bag in a less tightly rolled configuration. To provide such a function, an expansion section is provided on the storage sack. A closure is provided on the expansion section.

3 Claims, 5 Drawing Sheets

U.S. PATENT DOCUMENTS 2,018,809 A 10/1935 Rodgers
2,123,454 A 7/1938 Doppelt
2,454,013 A 11/1948 Scherzinger
2,720,854 A 10/1955 Stephenson
2,764,859 A * 10/1956 Hanselmann ..... 53/434
2,783,808 A 3/1957 Renz et al.
2,971,205 A 2/1961 Shultz
3,042,939 A 7/1962 Schoellkopf
3,045,261 A 7/1962 Hocherman
3,292,747 A 12/1966 Dawson
3,477,552 A 11/1969 Goldman
3,633,227 A 1/1972 Tegeler
3,750,202 A 8/1973 Merikallio
4,153,146 A 5/1979 Patton et al.
D254,220 S 2/1980 Davis
4,223,056 A 9/1980 Di Fronzo
4,312,431 A 1/1982 Corey
4,334,601 A 6/1982 Davis
4,361,215 A 11/1982 Sawai
4,375,111 A 3/1983 Hall
4,466,124 A * 8/1984 Kirkham, Jr. ..... 383/2
D280,264 S 8/1985 Lipsig
4,574,397 A 3/1986 Dennard
4,575,876 A 3/1986 Weaver
D283,465 S 4/1986 Allen
4,587,682 A 5/1986 Schultz
4,603,432 A 7/1986 Marino
4,604,765 A 8/1986 Schultz
4,661,989 A * 4/1987 Risby ..... 383/2
4,738,545 A 4/1988 Westgor
4,757,832 A 7/1988 Russell
4,774,734 A 10/1988 Mills
4,789,247 A 12/1988 Schnoor
4,830,154 A 5/1989 Gerch et al.
4,856,912 A 8/1989 Damus et al.
4,919,240 A 4/1990 Tobias
4,953,673 A 9/1990 Ambasz
4,953,768 A 9/1990 Muse
4,969,751 A 11/1990 Diamond et al.
4,980,935 A 1/1991 Kazanowski et al.
4,989,282 A 2/1991 Goldstein
4,993,846 A 2/1991 Diamond et al.
5,060,795 A 10/1991 Bomes et al.
5,088,139 A 2/1992 Bloom
5,110,219 A 5/1992 Lopes
5,125,547 A * 6/1992 Russell ..... 224/637
5,129,519 A 7/1992 David et al.
5,184,361 A 2/1993 Canter et al.
5,195,828 A 3/1993 Bush-Rodriquez
5,287,571 A 2/1994 Rademacher
5,307,908 A 5/1994 Shyr et al.
5,324,115 A 6/1994 Weinreb
5,346,308 A 9/1994 Buhot et al.
5,404,600 A 4/1995 DeMars
5,490,294 A * 2/1996 Kramer ..... 5/413 R
5,509,141 A 4/1996 Saltzman
5,644,807 A 7/1997 Battistella
5,785,219 A 7/1998 Kraft
5,787,504 A 8/1998 Wu
5,815,833 A 10/1998 Kuo
5,878,551 A * 3/1999 Curley et al. ..... 53/434
5,887,301 A 3/1999 Anderson
5,920,931 A 7/1999 Zuehlke et al.
5,941,638 A 8/1999 Fonseca
6,059,078 A 5/2000 Nykoluk
6,089,752 A * 7/2000 Moore ..... 383/2
6,128,794 A * 10/2000 Pariseau ..... 5/413 R
6,161,665 A 12/2000 Hoover
6,202,910 B1 3/2001 Swetish
6,216,290 B1 * 4/2001 Zemitis et al. ..... 5/413 R
D444,298 S 7/2001 Starck
D447,632 S 9/2001 Gisser
6,283,260 B1 9/2001 Yasuda, Sr.
6,367,083 B1 4/2002 November
6,421,852 B1 7/2002 Shao
6,438,774 B1 8/2002 Michaelis et al.
D473,375 S 4/2003 Goeckeritz
6,543,072 B2 * 4/2003 Hsu ..... 5/413 R
6,582,123 B1 6/2003 Tang
6,595,687 B2 7/2003 Godshaw et al.
6,676,009 B1 1/2004 Rose
6,746,388 B2 6/2004 Edwards et al.
6,952,845 B1 10/2005 Akkad
6,966,439 B2 11/2005 Weleczki
7,083,331 B2 * 8/2006 Nykoluk ..... 383/2
7,243,875 B2 7/2007 Holub et al.
2002/0104162 A1 8/2002 Stewart
2006/0006274 A1 1/2006 Holub et al.

FOREIGN PATENT DOCUMENTS

DE 10329797 A1 2/2005
EP 0404448 A2 12/1990

OTHER PUBLICATIONS

U.S. Appl. No. 10/864,971, filed Jun. 10, 2004.

* cited by examiner

EXPANDABLE SLEEPING BAG STORAGE SACK

CROSS-REFERENCE TO RELATED APPLICATION

This patent application is a continuation-in-part of U.S. patent application Ser. No. 10/864,971, filed Jun. 10, 2004, now U.S. Pat. No. 7,243,875 which is incorporated herein by reference.

TECHNICAL FIELD OF THE INVENTION

The present invention is directed to sleeping bags, and more particularly to sleeping bag storage sacks.

BACKGROUND OF THE INVENTION

In general, a sleeping bag is a bag that is warmly lined or padded for sleeping outdoors, for example in a tent. Sleeping bags may also be used for sleeping on the floor inside a house, such as on a sleepover, or may be used as convenient bedding material when traveling.

Sleeping bags typically include a bottom portion, upon which an individual within the sleeping bag lays, and a top portion which extends over to cover the individual. Often, the top and bottom portions are made of a single, large rectangular insulated or padded fabric that is folded and attached along bottom and side edges to form the bag. The attachment is typically made by a zipper.

Sleeping bags are often folded lengthwise and rolled into a tight cylinder for storage. After rolled, most rolled rectangular sleeping bags are tied with tie cords, compression straps, or elastic straps, or may be otherwise secured so that the sleeping bag does not become unrolled during storage.

Other sleeping bags may not be rolled for storage, and instead may be stuffed into a storage sack, sometimes called a stuff sack. Stuff sacks may also be used for rolled sleeping bags.

In general, when a sleeping bag is put on display at a store, it is desired that the sleeping bag look large, or fluffy, so that a user will perceive that the fill for the sleeping bag is sufficient to keep the user warm and is also comfortable. Thus, if possible, the sleeping bag is presented so that it looks rather large. However, for shipping, particularly shipping overseas, it is desired that the sleeping bag be compacted as small as possible so that shipping charges, which often are set by volume, may be minimized per sleeping bag.

These two different goals are hard to meet in a single sleeping bag container. Moreover, because the use of store personnel is expensive, stores do not want their employees to have to re-package items, such as sleeping bags, so that the items can be placed on a shelf.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with an embodiment, a storage sack is provided for a sleeping bag. The storage sack is configurable between a first state where the storage sack contains the sleeping bag in a tight configuration, and a second state where the storage sack expands to hold the sleeping bag in a less tight configuration. In accordance with an embodiment, to provide such a function, an expansion section is provided for the storage sack which allows the storage sack to expand from the first state to the second state. In addition, in accordance with an embodiment, a closure may be provided to lock the expansion section in the first state.

In accordance with an embodiment, the sleeping bag may be shipped to a store in the tightly compacted arrangement, with the storage sack in the smaller, unexpanded state. Upon arrival at the store, a store clerk opens the closure to allow the storage sack to expand to the expanded state. By doing so, the storage sack expands to look soft and thick, which may be more attractive to consumers. In addition, because a user may find it hard to reinsert the sleeping bag into the storage sack while the storage sack is in the first state, the user may instead use the storage sack in the expanded, second state.

In accordance with an embodiment, an end or other portion of the storage sack includes a section that is the same color, texture, material, and/or pattern as the liner for the sleeping bag. In addition, information regarding the sleeping bag may be included on the storage sack, for example by screen printing the information on the storage sack. In this manner, a user does not have to open the sleeping bag to know its contents.

Other features of the invention will become apparent from the following detailed description when taken in conjunction with the drawings, in which:

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
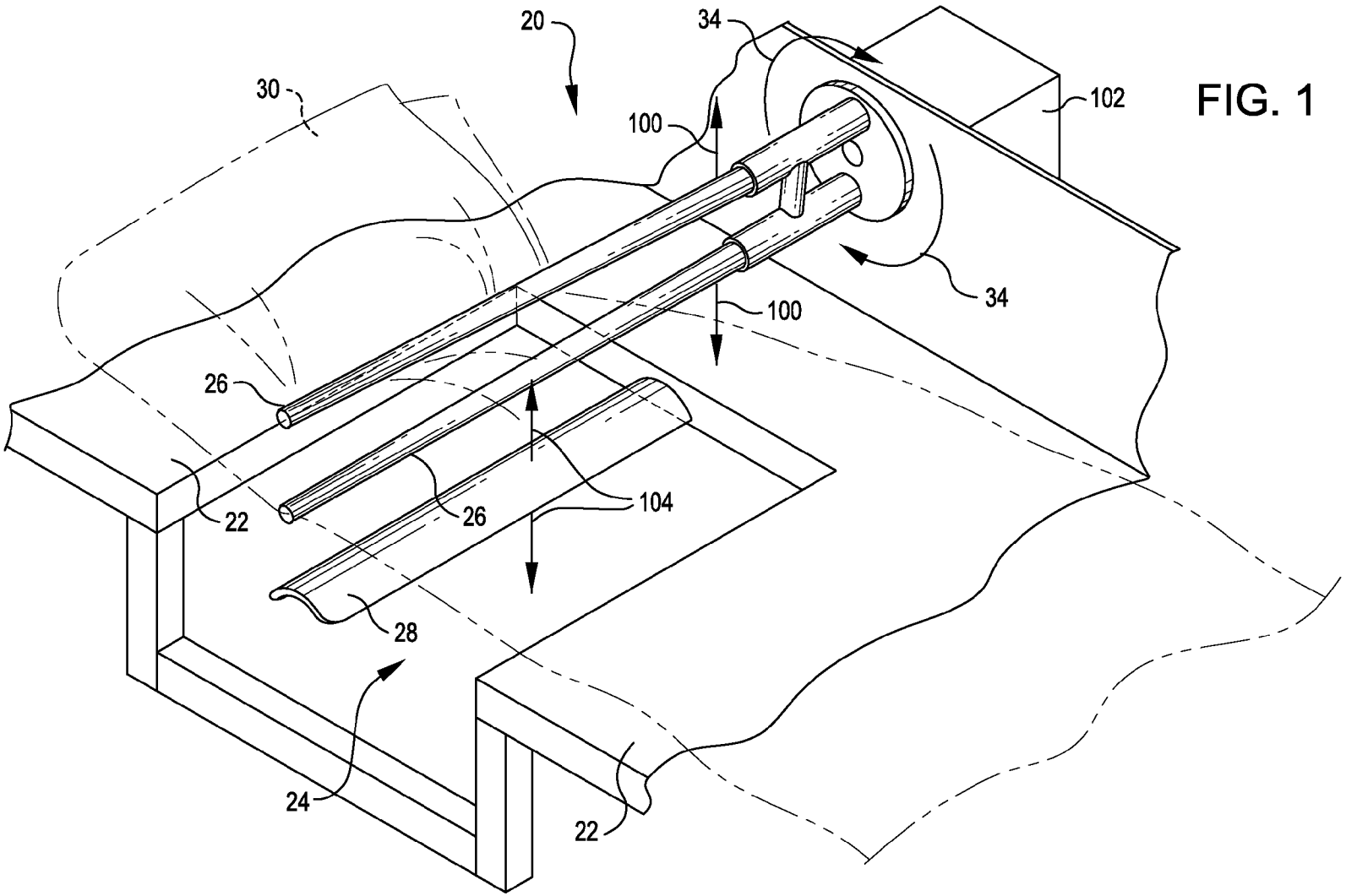
FIG. 1 is a side perspective view of a sleeping bag rolling machine for use in accordance with a method of the present invention.

Referring now to the drawings, in which like reference numerals represent like parts throughout the several views, FIG. 1 shows a side perspective view of a rolling machine 20 that may be utilized for rolling a sleeping bag in accordance with a method of the present invention. The rolling machine 20 includes a table 22 having an opening 24. A pair of roller tines 26 are positioned over the opening 24, and a fixed bar 28 extends across the opening 24, parallel to and underneath the roller tines 26. In operation, the roller tines 26 rotate as generally indicated by the arrows 34 in FIG. 1.

In the embodiment shown in the drawings, the roller tines 26 are attached to an "H" shaped base, when in turn is attached to a circular base plate. The roller tines 26 may alternatively be attached directly to the base, for example by welding, or another suitable attachment.

In general, the sleeping bag rolling machine 20 is known in the art. However, modifications to the sleeping bag rolling machine 20 have been made, and a change in the method of rolling a sleeping bag is utilized, to produce a tightly rolled sleeping bag that is much smaller in diameter than prior rolled sleeping bags utilizing similar sleeping bag rolling machines.

Figure 2:
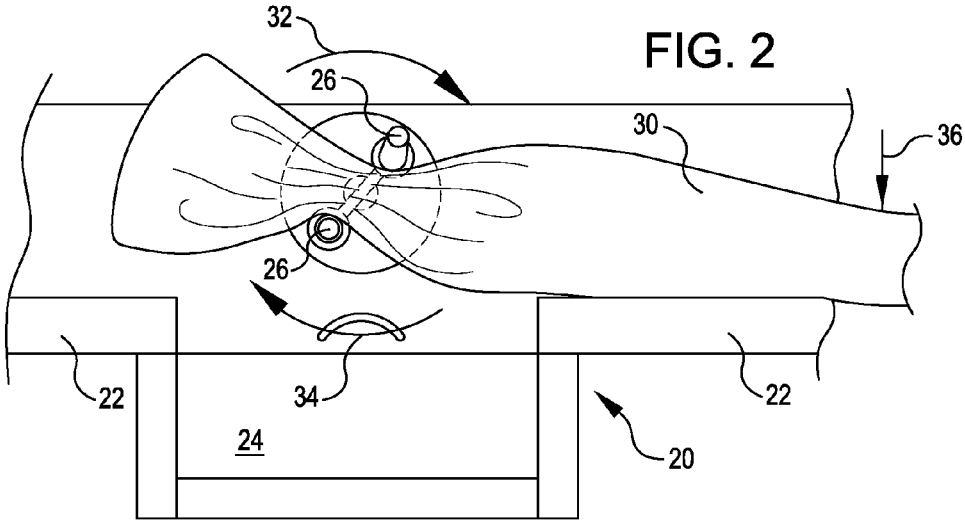
FIG. 2 is a side view of the sleeping bag machine of FIG. 1, with a sleeping bag mounted therein, and shown at a beginning stage of rolling the sleeping bag.

As is known, to roll a sleeping bag, such as a sleeping bag 30 shown in FIG. 2, with the sleeping bag rolling machine 20, an end of the sleeping bag 30 is initially extended through the two roller tines 26, such as is shown in FIG. 2. The sleeping bag 30 may be folded lengthwise prior to inserting it into the roller tines 26. A portion of the sleeping bag 30 extending beyond the roller tines 26 is then folded over on top of the other portion of the sleeping bag 30, as is indicated by the arrow 32 in FIG. 2. Then, in accordance with the prior art, the user holds this extended portion of the sleeping bag 30 into place and then causes the roller tines 26 to rotate in the direction shown by the arrows 34 in FIGS. 1 and 2. This rotation of the roller tines 26 cause the sleeping bag 30 to be rolled into a cylinder.

In accordance with an embodiment of the present invention, the user applies force to the sleeping bag 30 while it is rolling, resisting rolling of the sleeping bag 30. Such a force is indicated by the arrow 36 in FIG. 2, and may be supplied, for example, by putting a hand on the sleeping bag 30 or two users' hands on the sleeping bag 30. This force on the sleeping bag 30 resists the sleeping bag 30 moving toward the roller tines 26, and causes the sleeping bag 30 to be pulled tighter. As such, the airiness or fluffiness of the sleeping bag 30 is reduced, resulting in the sleeping bag 30 being rolled tighter on the roller tines 26. The user maintains this pressure on the sleeping bag 30 while the sleeping bag 30 is being rolled on the roller tines 26. The pressure is sufficient to pull the sleeping bag 30 taut, but enough release is permitted so that the sleeping bag 30 may be continually rolled onto the roller tines 26.

Figure 3:
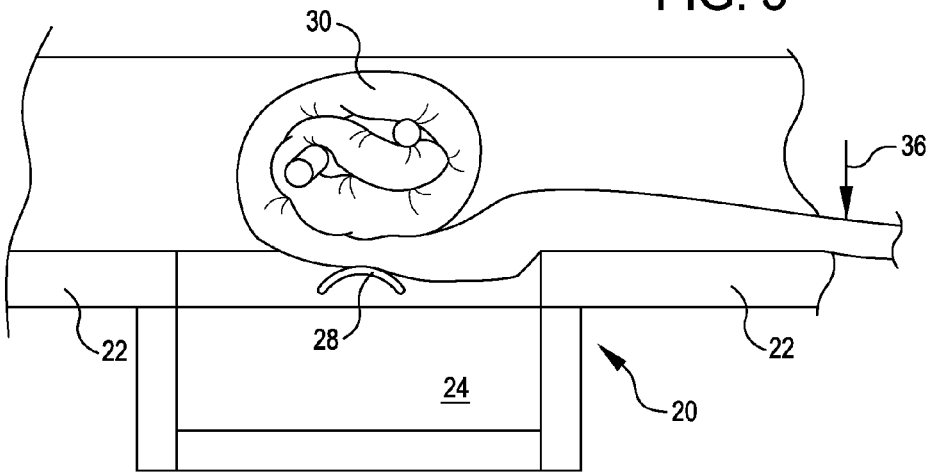
FIG. 3 is a side view of the sleeping bag rolling machine of FIG. 2, shown in a further stage of rolling the sleeping bag.
Figure 4:
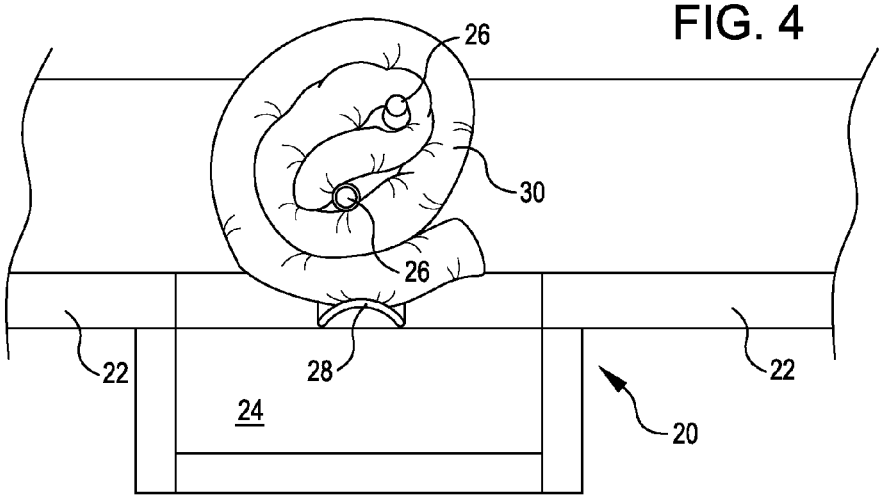
FIG. 4 is a side view of the sleeping bag rolling machine of FIGS. 2 and 3, showing the sleeping bag fully rolled.

A continued stage of rotation is shown in FIG. 3. The user continues to apply pressure until the sleeping bag 30 is completely rolled, such as is shown in FIG. 4. At this stage, the fixed bar 28 holds the end of the sleeping bag 30 in position, preventing the sleeping bag from unrolling. To this end, the fixed bar 28 is appropriately spaced from the roller tines 26 so that the fixed bar may apply the appropriate amount of pressure to prevent release of the sleeping bag 30 from the roller tines 26. Because the sleeping bag 30 is rolled tighter than prior art sleeping bags, in accordance with an embodiment of the sleeping bag rolling machine 20, the fixed bar 28 is positioned closer to the roller tines 26 so that the fixed bar may hold a completely rolled sleeping bag in the tighter configuration.

To provide appropriate spacing, the roller tines 26 may be movable toward and away from the fixed bar 28, such as is indicated by the arrows 100 in FIG. 1. To this end, a drive unit 102 for the roller tines 26 may be slidably mounted to the sleeping bag rolling machine 20, permitting the drive unit and the roller tines 26 to slide upward. Similarly, the fixed bar 28 may be slidably mounted to the sleeping bag rolling machine 20, and may move in the direction of the arrows 104. Alternatively, both may be movable. In addition, if desired, one or both may be biased, such as by a spring (not shown), to permit the fixed bar 28 and the roller tines 26 to apply appropriate pressure to the rolled sleeping bag 30.

Figure 5:
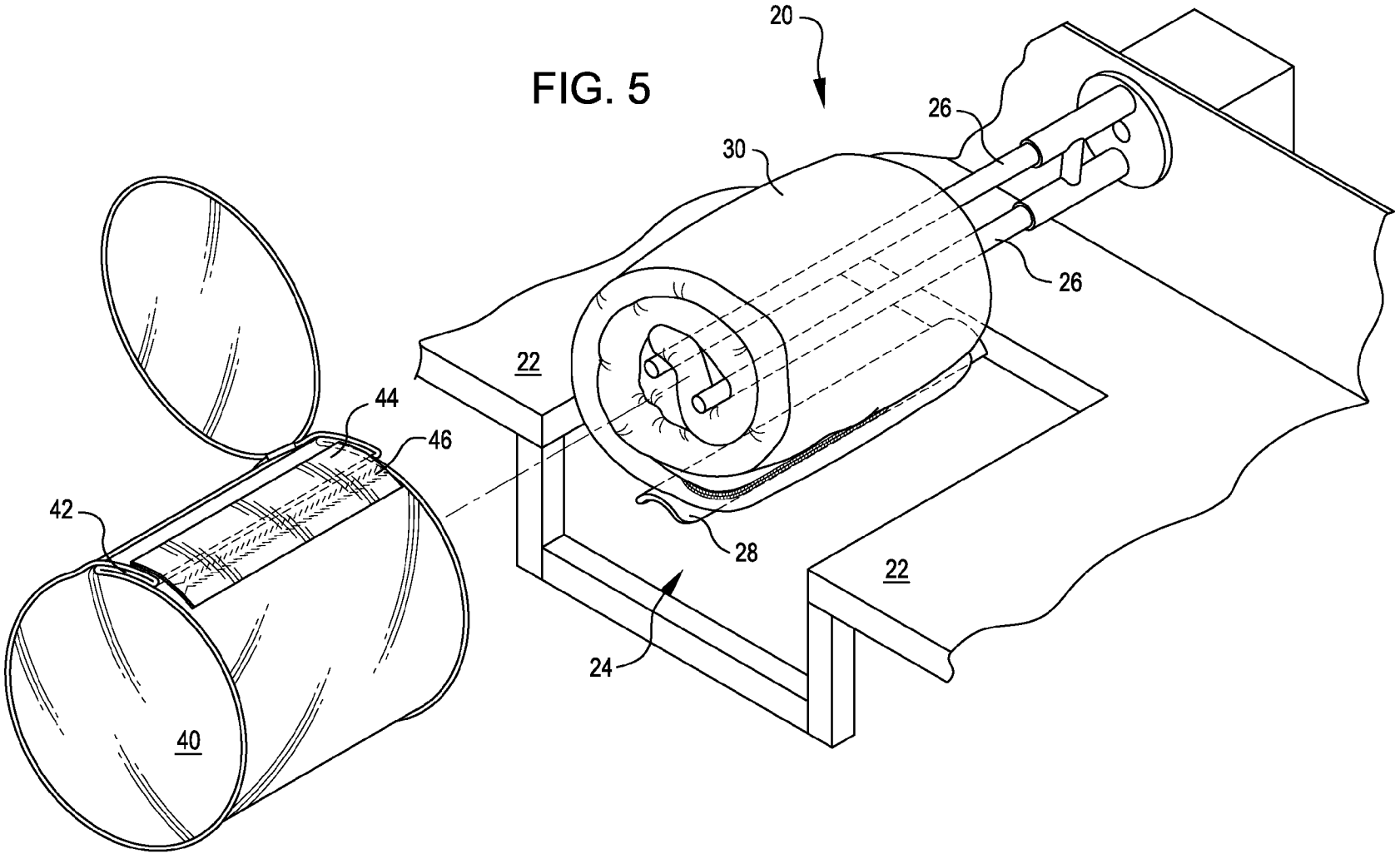
FIG. 5 is a side perspective view of the sleeping bag rolling machine of FIG. 1, with the sleeping bag fully rolled as shown in FIG. 4, and just before a storage sack is placed over the sleeping bag.

After the sleeping bag 30 is fully rolled (FIG. 4), a storage sack 40 (FIG. 5) is extended around the sleeping bag 30. The opening 24 in the sleeping bag rolling machine 20 provides ample room for extending the storage sack 40 over and around the sleeping bag 30. This method of applying a storage sack over a sleeping bag is utilized with prior art sleeping bag rolling machines.

After the storage sack 40 is extended fully over the sleeping bag 30, the operator pulls backward on the sleeping bag 30 and the storage sack 40 to remove the sleeping bag 30 from the roller tines 26 and the fixed bar 28. To aid in this removal, in accordance with an embodiment of the sleeping bag rolling machine 20, the roller tines 26 are tapered. This feature permits easier removal of the sleeping bag 30 from the roller tines 26, especially in arrangements wherein the sleeping bag 30 is rolled tightly.

Using the rolling method described above, significant volume savings can be realized in packing a sleeping bag for shipping. For example, for one prior art sleeping bag sold by the assignee of the present invention, The Coleman Company, Inc., a standard sleeping bag size 33 inches by 75 inches, with a polyester fiber fill and fill weight of 4 pounds, which previously was rolled to a diameter of 13.75 inches, now is rolled to a diameter of 10.25 inches. In a second example, a large sleeping bag, having a size of 39 inches by 81 inches, with a polyester fiber fill and fill weight of 6 pounds, which was previously rolled to a 16 inch diameter, is rolled to an 11.5 inch diameter. In both these examples, the sleeping bag is folded lengthwise before rolling. As can be realized, such volume reduction can significantly reduce shipping volume, which in turn reduces cost per unit of the sleeping bag 20.

In accordance with an embodiment, the storage sack 40 includes an expansion section 42 (FIG. 6) in its casing. The expansion section 42 is configured to permit the storage sack to increase in volume, and may be any suitable structure including an elastic, stretchy section or another structure that allows expansion. In the embodiment shown in FIG. 6, the expansion section 42 is a portion of the storage sack 40 folded onto itself, accordion style, so as to make the storage sack 40 smaller. The portion of the storage sack that is made more compact may be folded, crumpled, allowed to hang loose, or may otherwise be pressed together to make the circumference of the storage sack smaller. The storage sack 40 is shown in the smaller, unexpanded state in FIG. 6. The portion of the storage sack 40 that serves as the expansion section 42 may be formed of the same material or a different material than the rest of the casing for the storage sack 40.

Figure 6:
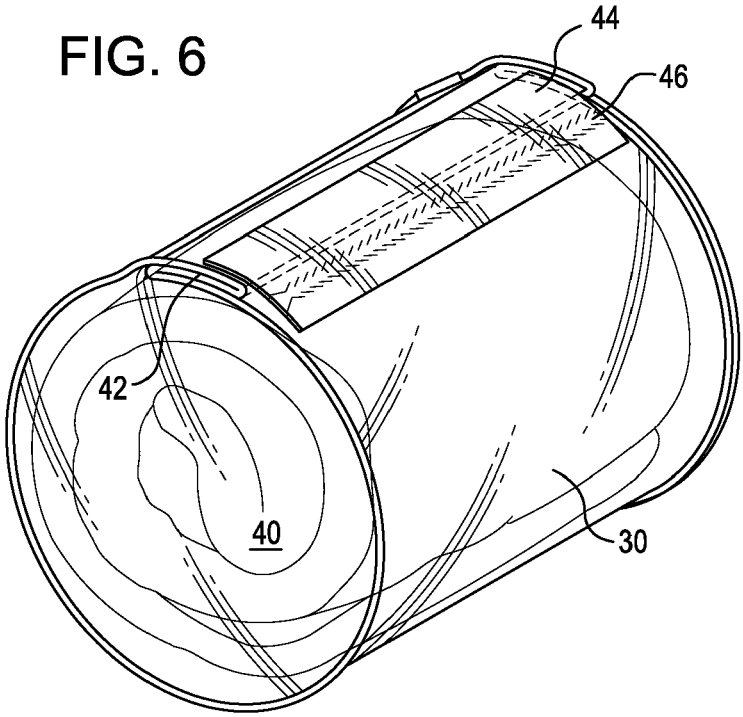
FIG. 6 is a side perspective view of the sleeping bag as rolled in FIG. 5, showing the sleeping bag within the storage sack, with the storage sack in a smaller, unexpanded state.

In accordance with an embodiment, a closure 44 is provided for maintaining the expansion section 42 of the storage sack 40 in the smaller, unexpanded state. The closure 44 in the embodiment shown in FIG. 6 is a large adhesive strip having a removable tab 46 extending along the middle of its length. To release and open the expansion section 42, the tab is pulled to separate the closure. The sleeping bag 30 expands to fill the larger volume of the storage sack 40 that is provided by opening the expansion section.

Although the storage sack 40 in FIG. 6 utilizes the adhesive strip having a removable tab 46 for the closure 44 for the expansion section 42, other closures may be used. These closures may be re-closeable, such as a zipper, so that the storage sack 40 may be moved between the expanded state and the collapsed state after being opened. Alternatively, the closures may be permanently detachable, such as the adhesive strip and removable tab 46, so that the storage sack 40 remains in the expanded state after the closure is opened. Other examples of closures include, but are not limited to, straps, ties, hook and loop fasteners, buttons, snaps, hooks, loops and toggles, tearable strips, tape, and other releasable fasteners.

Figure 8:
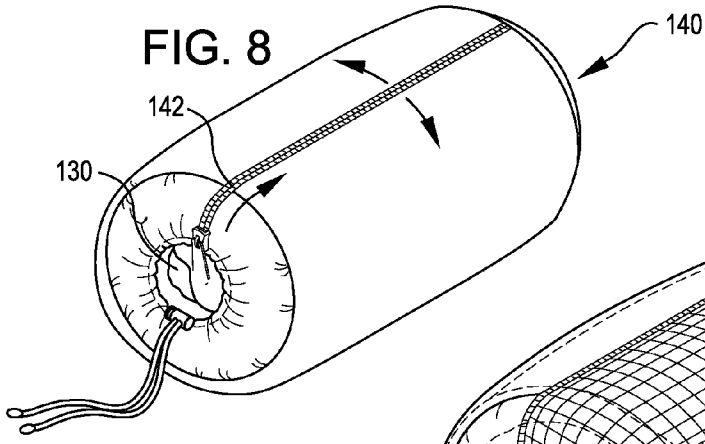
FIG. 8 is a side perspective view of a storage sack with sleeping bag therein in accordance with an embodiment, with the storage sack in a smaller, unexpanded state.
Figure 9:
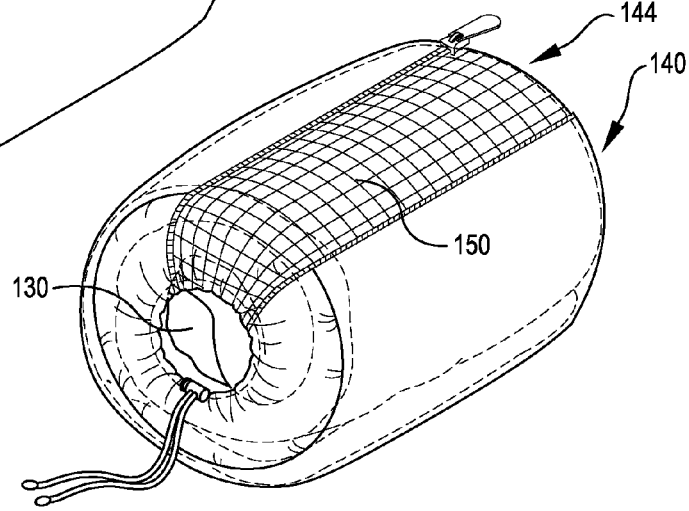
FIG. 9 is a side perspective view of the storage sack of FIG. 8, with the storage sack expanded to an expanded state.
Figure 10:
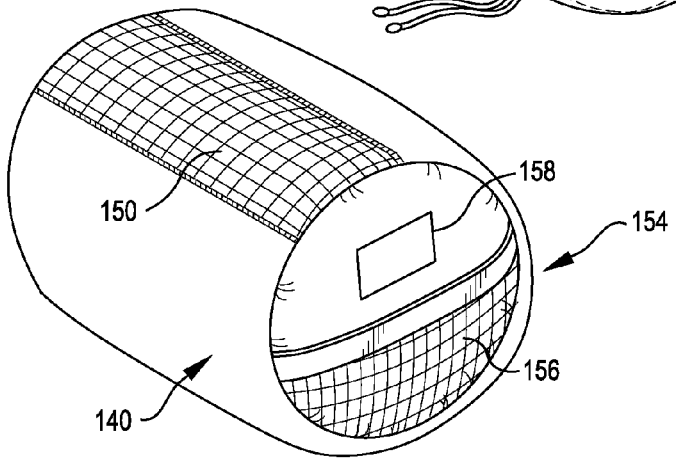
FIG. 10 is a rear, side perspective view of the storage sack shown in FIG. 9.

An example of an alternate embodiment of an expansion section for a storage sack 140 is shown in FIGS. 8-10. In this embodiment, the closure is a zipper 142. The zipper 142 may be unzipped to expose an expansion section 144. When in the collapsed state shown in FIG. 8, the expansion section 144 is folded, crumpled, or otherwise stuffed inside the storage sack 140 so that the zipper 142 may be closed. When the zipper 142 is released, the expansion section 144 expands, making the storage sack 140 much larger so that a sleeping bag 130 stored within the storage sack is kept in a much less compact manner.

Although described as being rolled in embodiments above, a sleeping bag held by one of the storage sacks, such as the storage sacks 40 or 140, may be stuffed into a storage sack 140 without rolling the sleeping bag. As nonlimiting examples, the sleeping bag may be folded or simply stuffed into the sleeping bag without folding or rolling. In addition, the sleeping bag may be compressed and/or vacuum sealed.

Use of a reclosable closure, such as the zipper 142, permits the expansion section 144 to be closed again, putting the storage sack 140 back into the shape shown in FIG. 8, wherein the sleeping bag 130 is held in a more tightly compact state. A user may only be able to close the zipper 142 when the sleeping bag 130 is out of the storage sack 140. Being able to return the storage sack back to the unexpanded position permits a user to store a sleeping bag in the expanded state shown in FIG. 9, but to utilize the storage sack 140 in the tighter configuration in FIG. 8, for example when the user takes the storage sack 140 on a backpacking trip.

Figure 7:
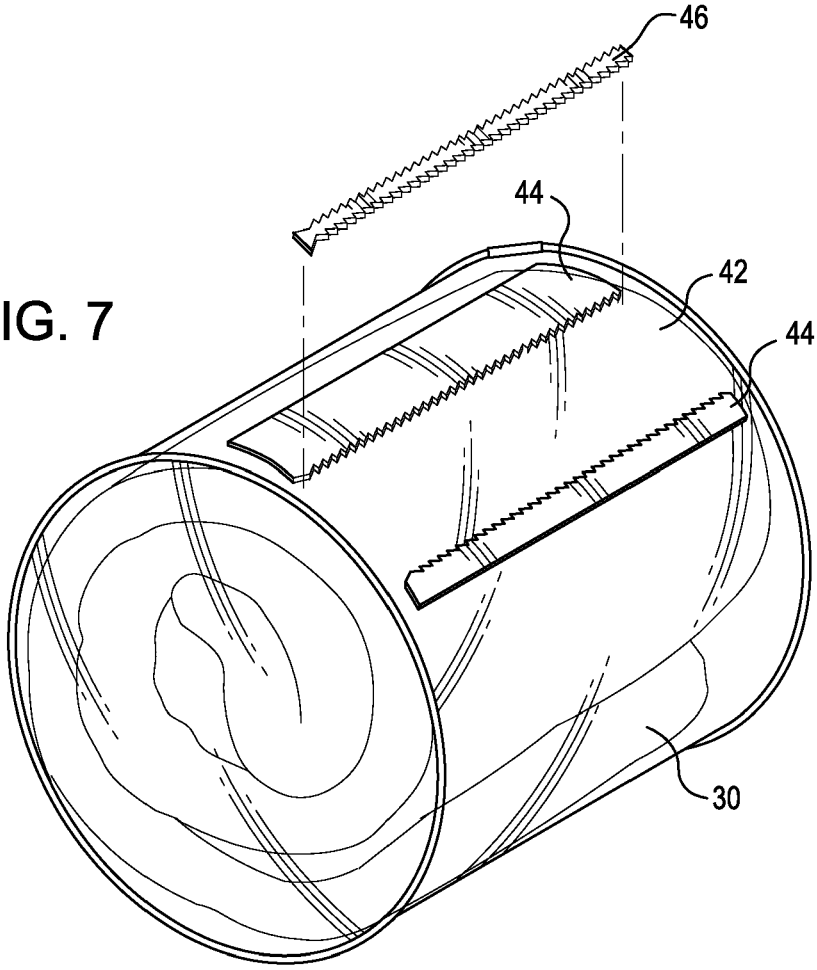
FIG. 7 is a side perspective view of the storage sack and sleeping bag of FIG. 6, with the storage sack expanded to an expanded state.

The sleeping bag 30 or 130 may be shipped to a store or other retail location with the storage sack 40 or 140 in the smaller, unexpanded state shown in FIG. 6 or 8. Then, when the sleeping bag 30 or 130 arrives at the store and is ready to be put on the shelf, a store clerk may open the closure 44, in the embodiment shown in FIG. 6 by tearing off the removable tab 46 and the embodiment shown in FIG. 8 by releasing the zipper 142, allowing the storage sack 40 or 140 to expand to the expanded state shown in FIG. 7. In this position, the sleeping bag 30 or 130 is allowed to expand in the storage sack 40 or 140, giving the sleeping bag a much fuller, softer, fluffier appearance. This appearance may be more suitable for sale of sleeping bags, especially where consumers are looking for a softer, warmer sleeping bag.

However, if desired, if the store wishes to preserve shelf space, the sleeping bag 30 or 130 may be placed on a shelf with the storage sack 40 or 140 maintained in the smaller, unexpanded state as shown in FIG. 6 or 8, permitting more sleeping bags to be stacked on the shelf. Alternatively, one or more of the sleeping bags may be expanded to the expanded state shown in FIG. 7 or 9, while others are maintained, for example, on a higher shelf, in the smaller, unexpanded state shown in FIG. 6 or 8. In either event, the storage sack 40 permits the sleeping bag 30 to be presented in two different ways with very little work by a store clerk.

Figure 11:
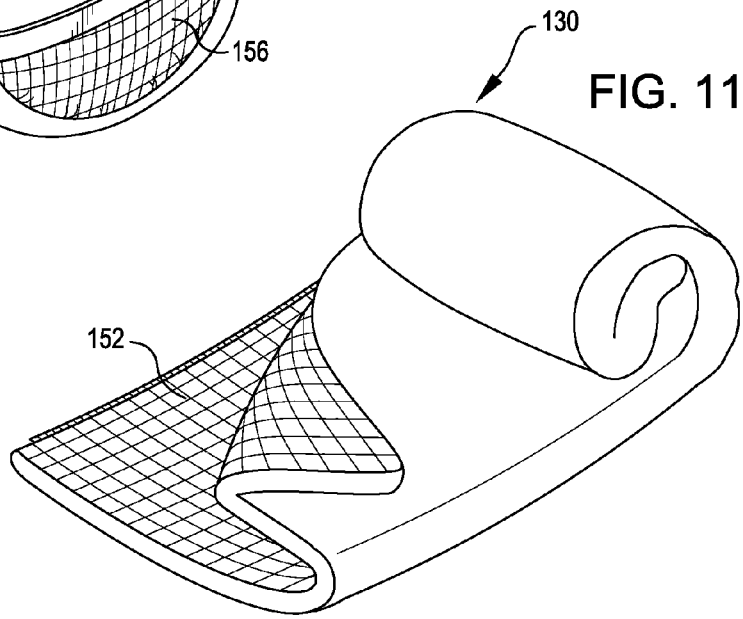
FIG. 11 is a side perspective view of a sleeping bag for the storage sack of FIGS. 8-10, with the sleeping bag partly rolled.

The embodiment of the storage sack 140 shown in FIGS. 8-10 provides another benefit. The expansion section 144 for that storage sack 140 is formed of a liner material 150. In an embodiment, the liner material 150 matches the material for the liner 152 (FIG. 11) of the inside of the sleeping bag 130. By providing the liner material 150 on the outside of the storage sack 140, a user may view the storage sack 140 when the storage sack is in the expanded position shown in FIGS. 9 and 10 and know the color, texture, material and/or pattern of the liner material without having to open the sleeping bag 130. This feature is convenient for marketing of the sleeping bag 130, and allows a user to peruse sleeping bags without taking the sleeping bags out of the storage sack 140. By simply viewing and/or touching the liner material 150, the user will know the material, color, texture, and/or pattern of the liner 152 of the sleeping bag 130.

In another embodiment, liner material 156 may be provided on an end 154 of the storage sack 140, as is shown in FIG. 10. The liner material 156 in the embodiment shown in the drawings covers one half of the end 154 of the storage sack 140. In this manner, the ends for multiple storage sacks 140 may be exposed off the end of a shelf by a retailer, and a consumer can view multiple ends and determine which combination the consumer would like to purchase.

In an embodiment, the exposed liner material 156 and/or liner material 150 may be the exact same material as the liner 152 for the sleeping bag 130, or may just be a reproduction of the color, pattern, and/or texture of the liner 152. In either event, the liner material 150 and/or 156 provides visual and/or tactile information regarding the liner 152 for the sleeping bag 130. In the same manner, the remainder of the casing for the storage sack may be made of the same material, or may be a reproduction of the color, pattern, and/or texture of, the outer cover of the sleeping bag 130.

In an embodiment, information regarding the sleeping bag 130 may be printed on the outside of the storage sack 140. As an example, a print screen 158 is provided on the end 154 that includes information about fill material, usage temperatures, liner material, or other information that may be relevant to a consumer making a sleeping bag purchase. By placing the liner material 156 and the print screen 158 on the end 154, the consumer is provided all information that the consumer needs regarding a purchase decision. In this manner, a retailer may take maximum advantage of shelf space by exposing only the ends of multiple sleeping bags. In addition, the unique expandable nature of the storage sack 140 permits the retailer to store the sleeping bag in a compact position for shipping and/or shelf space, and allows expansion of the storage sack 140 for storage of the sleeping bag and to permit a user to more easily reinsert the sleeping bag into the storage sack 140. The combination of the above features permits a retailer to have the sleeping bag 130 shipped to a retailer in the storage sack 140, without the need for a cardboard box, another merchandising bag, or a different storage sack. Thus, there is less waste and the storage sack 140 provides a more environmentally friendly method of shipping, retailing, and using a sleeping bag than prior art sleeping bags.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A sleeping bag storage sack, comprising:

a casing; and an expansion section in the casing configurable between a first arrangement where the storage sack may contain a first volume, and a second arrangement where the expansion section may be released and expands so that the storage sack may contain a second volume, the second volume being larger than the first volume;

further comprising a closure for maintaining the expansion section in the first arrangement;

wherein the closure is one-time detachable.

2. The sleeping bag storage sack of claim 1, wherein the closure comprises a removable tab.

3. A sleeping bag storage sack, comprising:

a casing; and and an expansion section in the casing configurable between a first arrangement where the storage sack may contain a first volume, and a second arrangement where the expansion section may be released and expands so that the storage sack may contain a second volume, the second volume being larger than the first volume; and further comprising a sleeping bag having a liner and an outer cover, and wherein the casing and the outer cover comprise a first material, and the expansion section and the liner comprise a second material.

* * * * *